US006234336B1

(12) United States Patent
Neiner

(10) Patent No.: US 6,234,336 B1
(45) **Date of Patent: *May 22, 2001**

(54) STAY-ON-TAB CONTAINER CLOSURE HAVING TEAR PANEL WITH NO CONTOUR FEATURES ON THE UPPER SURFACE

(75) Inventor: Christopher G. Neiner, St. Louis, MO (US)

(73) Assignee: Metal Container Corporation, St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/742,970

(22) Filed: Nov. 1, 1996

(51) Int. Cl.[7] ..... B65D 17/34
(52) U.S. Cl. ..... 220/269; 220/906
(58) Field of Search ..... 200/269, 270, 200/906

(56) References Cited

U.S. PATENT DOCUMENTS

| | | |
|---|---|---|
| Re. 31,702 | 10/1984 | Brown . |
| D. 244,915 | 7/1977 | Cudzik . |
| D. 263,802 | 4/1982 | Fraze . |
| D. 263,803 | 4/1982 | Fraze . |
| D. 265,463 | 7/1982 | Hasegawa . |
| D. 266,991 | 11/1982 | Hasegawa . |
| D. 275,373 | 9/1984 | Brown et al. . |
| D. 279,265 | 6/1985 | Turner et al. . |
| D. 327,424 | 6/1992 | Pierce . |
| D. 338,156 | 8/1993 | Cook . |
| D. 364,807 | 12/1995 | Taylor . |
| D. 365,988 | 1/1996 | Clarke, III . |

(List continued on next page.)

FOREIGN PATENT DOCUMENTS

| | | | |
|---|---|---|---|
| 967898 * | 5/1975 | (CA) | 220/270 |
| 0432659A1 | 6/1991 | (EP) . | |
| 564725 | 10/1993 | (EP) . | |
| 704382 | 4/1996 | (EP) . | |
| 6-24443 | 2/1994 | (JP) . | |

OTHER PUBLICATIONS

Ecology End Drawing and PMO Request, Ball Packaging Products Group, May 17, 1996, 2 pages.

*Primary Examiner*—Allan N. Shoap
*Assistant Examiner*—Robin A Hylton
(74) *Attorney, Agent, or Firm*—Carr & Storm, L.L.P.

(57) ABSTRACT

A stay-on-tab container closure suitable for use on beverage cans and the like, said closure including an center panel with an downwardly displaceable tear panel, which, in one aspect, has a smooth upper surface having no visually perceptible contour features, and which, in another aspect, has low-relief contour features on its upper surface. Closures according to the invention have reduced stresses across the score defining the tear panel, thereby reducing the likelihood of stress-induced fatigue cracking which can lead to score failure when the container closure is joined to a can body and the resulting can is internally pressurized.

7 Claims, 5 Drawing Sheets

U.S. PATENT DOCUMENTS

| | | | | |
|---|---|---|---|---|
| 3,967,752 | | 7/1976 | Cudzik . | |
| 3,977,561 | | 8/1976 | Strobe et al. . | |
| 4,015,744 | | 4/1977 | Brown . | |
| 4,024,981 | | 5/1977 | Brown . | |
| 4,062,471 | * | 12/1977 | Perry | 220/269 |
| 4,084,721 | * | 4/1978 | Perry | 220/269 |
| 4,105,134 | | 8/1978 | Debenham et al. . | |
| 4,148,410 | | 4/1979 | Brown . | |
| 4,150,765 | | 4/1979 | Mazeruk . | |
| 4,184,607 | | 1/1980 | Potts . | |
| 4,205,760 | | 6/1980 | Hasegawa . | |
| 4,210,257 | | 7/1980 | Radtke . | |
| 4,211,335 | | 7/1980 | Langseder . | |
| 4,247,014 | | 1/1981 | Walz . | |
| 4,276,993 | | 7/1981 | Hasegawa . | |
| 4,318,493 | | 3/1982 | Jacobsen et al. . | |
| 4,320,850 | | 3/1982 | Drolen, Jr. . | |
| 4,361,251 | | 11/1982 | Langseder et al. . | |
| 4,363,419 | | 12/1982 | Walz, Sr. . | |
| 4,367,996 | * | 1/1983 | Saunders | 220/270 X |
| 4,387,827 | | 6/1983 | Ruemer, Jr. . | |
| 4,402,421 | | 9/1983 | Ruemer, Jr. . | |
| 4,465,204 | | 8/1984 | Kaminski et al. . | |
| 4,530,631 | | 7/1985 | Kaminski et al. . | |
| 4,872,597 | | 10/1989 | Hanafusa . | |
| 4,930,658 | | 6/1990 | McEldowney . | |
| 4,994,009 | | 2/1991 | McEldowney . | |
| 5,011,037 | | 4/1991 | Moen et al. . | |
| 5,064,087 | * | 11/1991 | Koch | 220/269 |
| 5,129,541 | * | 7/1992 | Voigt et al. | 220/269 |
| 5,307,947 | | 5/1994 | Moen et al. . | |
| 5,405,039 | | 4/1995 | Komura . | |
| 5,653,355 | * | 8/1997 | Tominaga et al. | 220/269 |
| 5,711,448 | | 1/1998 | Clarke, III . | |
| 5,813,561 | * | 9/1998 | Chang et al. | 220/269 |
| 5,829,623 | * | 11/1998 | Otsuka et al. | 220/269 |
| 5,860,553 | * | 1/1999 | Schubert | 220/269 X |
| 5,964,366 | * | 10/1999 | Hurst et al. | 220/269 |
| 6,050,440 | * | 4/2000 | McEldowney | 220/269 |

* cited by examiner

STAY-ON-TAB CONTAINER CLOSURE HAVING TEAR PANEL WITH NO CONTOUR FEATURES ON THE UPPER SURFACE

TECHNICAL FIELD OF THE INVENTION

This invention relates generally to closures of the type used for metal beverage containers and, more particularly, to stay-on-tab closures in which an attached tab is lifted to partially sever and displace a tear panel to create an opening for dispensing the contents of the container. In one aspect, the current invention relates to a stay-on-tab closure having a tear panel with low-relief contour features on the upper surface.

BACKGROUND OF THE INVENTION

It is well known to use closures, also referred to as "ends" or "lids," for sealing metal beverage containers of the type used for packaging beer, carbonated soft drinks, juice, tea, water, and other liquids or fluids. These closures are typically formed of an aluminum alloy or steel, although other materials such as metal-plastic laminates or composites can also be used. A common type of closure, often referred to as a "stay-on-tab" closure, incorporates an attached tab which is lifted to partially sever and displace a tear panel defined by a frangible curvilinear score line. The downward displacement of the tear panel creates an opening for dispensing the contents of the container without the use of a separate opening tool. Both the tear panel and the tab remain attached to the closure after opening.

Conventional stay-on-tab closures typically include a center panel having a generally planar or slightly upwardly domed surface. A tear panel is defined by a curvilinear, but non-closed, frangible score line formed on the center panel which defines the general periphery of the tear panel but leaves a narrow integral hinge connecting the tear panel to the remainder of the center panel. An opening tab is secured to the center panel of the closure by a rivet or other such fastener hingedly connected to the tab. When one tab end is lifted upward, the tab applies forces to the tear panel and center panel to rupture the score line and displace the tear panel down into the associated container to form an opening through which the container contents can be dispensed. The non-closed portion of the score line forms a hinge which retains the tear panel with the closure. Similarly, the tab remains attached to the closure by its hinged connection to the rivet.

To facilitate the easy bending of the tear panel into the container during opening, conventional stay-on-tab closures connect the tear panel to the center panel using a narrow hinge, i.e., a hinge having a width less than about 25% of the maximum width of the tear panel. Unconventional container closures having displaceable panels and permanently affixed tabs are also known, such as described in U.S. Pat. No. 5,405,039 to Komura, and such closures may be referred to by some as "stay-on-tab" closures. The displaceable panels in such unconventional closures, however, are connected to the center panel by a hinge having a width significantly greater than 25% of the maximum width of the displaceable panel. For example, one closure in the previously mentioned Komura '039 patent provides a displaceable panel comprising approximately one-half of the top of the lid and a hinge having a width of approximately 100% of the maximum width of the displaceable panel. Because the forces relating to the opening and bending of such unconventional closures are significantly different than for conventional stay-on-tab closures, all further references to "stay-on-tab" closures in this application refer to closures having a hinge width less than about 25% of the maximum width of the tear panel.

All stay-on-tab container closures heretofore known include high-relief "contour features" formed in the tear panel and projecting substantially above the nearby generally planar surface of the tear panel. For the purposes of this application, a contour feature is considered to have "high relief" when the "total height", or $H_T$, of the feature is not less than about 2 times the thickness of the sheet material used to form the lid. The total height, $H_T$, of a contour feature is the vertical distance from the highest point on the upper surface of the contour feature to the level of the underside of the surrounding generally planar tear panel material. One contour feature commonly used on tear panels is a raised curvilinear ridge generally referred to as a "bead." It is known to use high-relief beads having a variety of configurations, when viewed from above, including a non-closed curve resembling the letter "C" (sometimes called a "C-bead"), a closed curve having one straight side resembling the letter "D" (sometimes called a "D-bead"), a closed curve of circular or oval shape, or an irregular closed or non-closed shape. For example, closures are known which are formed from sheet material having a thickness of about 0.0093 inches and having a high-relief bead on the tear panel with a total height, $H_T$, in the range of about 0.0200 to 0.0230 inches, as are closures formed from sheet material having a thickness of about 0.0090 inches and having a high-relief bead on the tear panel with a total height, $H_T$, of about 0.0180 inches. It must be noted that although beads are among the most common high-relief contour features found on tear panels, other high-relief contour features are also known, including ridges, panels, embossments, and various combinations of these features.

It was heretofore believed necessary to incorporate high-relief contour features on the tear panel of stay-on-tab container closures for one or more of the following reasons: 1) to serve as lateral stiffening or reinforcing structures on the tear panel so that the panel will not bow excessively or buckle during the opening operation, which can cause "nose failure" and "tuck-under" type failures; 2) to selectively distribute the forces of the opening tab across the tear panel to propagate the fracturing of the score line completely around the tear panel so the panel will not experience an "partial opening" type failure; and 3) to gather in the "slack metal" on the tear panel which results from the widening of the panel during formation of the score lines, thereby maintaining tension in the tear panel, the lack of which can also cause nose failure, tuck-under type failure, or partial opening type failure. A "nose failure" occurs when excessive bowing or buckling of the tear panel due to insufficient stiffness or insufficient tension allows the tab end to slip along the surface of the tear panel without rupturing the score line at all. A "tuck-under" type failure, also known as a "non-turn-under" type failure, occurs when the same factors cause the tab to only partially rupture the score line and not displace the tear panel far enough into the container to provide a useable opening. A "partial opening" type failure, also known as an "insufficient angle" type failure occurs when the score line fully ruptures, but bowing of the tear panel or inadequate distribution of tab forces prevents the tab from displacing the tear panel through a sufficient angle into the container to avoid obstructing the opening.

The operational problems described above are known for stay-on-tab container closures having "standard-size" openings, that is, openings defined by tear panels having an area of approximately 0.40 square inches, and the use of a high-relief bead or some other type of high-relief contour feature on the tear panel was heretofore believed necessary to overcome such problems. It was heretofore further believed that such operational problems are exacerbated on container closures incorporating so-called "large-size" openings, that is, openings defined by tear panels having an area of approximately 0.59 square inches or larger, and thus that the use of a high-relief bead or other contour feature on the tear panel was of increased necessity. See, for example, European Patent Application No. EP 0 704 382 A2.

Another factor affecting the performance of container closures is the gauge, or thickness, of the material used to form the closures. At one time, stay-on-tab container closures were manufactured using sheet metal "stock" having a thickness of at approximately 0.0100 inches or greater. In order to conserve materials and decrease costs, however, stay-on-tab container closures are now being manufactured from metal stock having a thickness in the range of approximately 0.0091 inches to 0.0085 inches, and the thickness is anticipated to continue decreasing in the future. As the thickness of the sheet material used to make the container closures decreases, the operational behavior of the tear panel and its interaction with the tab also changes. Thus, container closure designs that function adequately for lids having a thickness of over 0.010 inches cannot be assumed to function identically for lids having a lesser thickness.

In fact, it has been discovered in connection with the development of the current invention that beverage containers using stay-on-tab container closures having a thickness of about 0.0091 inches or less and provided with high-relief contour features on the tear panels, as was heretofore thought necessary for proper opening function, experience an unacceptably high rate of score failure when the containers are internally pressurized to relatively high pressures, such as those normally encountered in a beverage pasteurizer or from handling during shipping. It should be noted that the absolute failure rate for such closures is very small, but due to the astronomical number of closures produced (tens of billions per year), a small change in the failure rate is of economic significance. Further, it has been determined that this score failure rate is highest on container closures having large-size openings, which are a growing segment of the closure market, adding to the economic significance. It has been determined in connection with the development of the current invention that the increased score failure rate is at least partially attributable to fatigue cracking of the container closure material along the score line. It is believed that the fatigue cracking is caused by excessive stress across the score line.

A need therefore exists, for a stay-on-tab container closure formed from sheet stock having a thickness, preferably of about 0.0091 inches or less, having conventional tear panel function and operation characteristics, and having reduced lateral stress across the score line to provide improved resistance to stress-induced cracking of the score line.

A need further exists for a stay-on-tab container closure having a large-size opening with an area of 0.59 square inches or greater, the container closure being formed from sheet stock having a thickness, preferably of about 0.0091 inches or less, having conventional tear panel function and operation characteristics, and having reduced lateral stress across the score line to provide improved resistance to stress-induced cracking of the score line.

SUMMARY OF THE INVENTION

For purposes of clarity and consistency some of the terms used in the specification and the claims hereof will now be defined. Directional terms such as "up," "down," "high,", "low," "upper," "lower," "top," "bottom," "side," "horizontal" and "vertical" refer to container closures as though they were disposed in operational relationship with an upright, level container body resting on a flat horizontal surface. Directional terms such as "in," "out," "inward" and "outward," relate to the interior of a can formed with a container closure.

It is an object of the current invention to provide a stay-on-tab container closure formed from sheet material having a thickness, preferably of about 0.0091 inches or less, having conventional tear panel function and operation characteristics, and having reduced lateral stress across the score line to provide improved resistance to stress-induced cracking of the score line.

It is a further object of the current invention to provide a stay-on-tab container closure having an opening defined by a tear panel having an area of approximately 0.59 square inches or greater, the closure being formed from sheet stock having a thickness, preferably of about 0.0091 inches or less, having conventional tear panel function and operation characteristics, and having reduced lateral stress across the score line to provide improved resistance to stress-induced cracking of the score line.

The above and other objects are realized by providing a stay-on-tab container closure comprising a generally circular center panel having upper and lower surfaces and being formed from a sheet material having a thickness. A frangible curvilinear score is formed on the upper surface of the center panel defining a displaceable tear panel, a hinge, and a fixed portion on the center panel. The tear panel has upper and lower surfaces and the upper surface of the tear panel is smooth, that is, it has no visually perceptible contour features. In a preferred embodiment, the sheet material has a thickness of 0.0091 inches or less. In a more preferred embodiment, supplemental contour features are provided on the fixed portion of the center panel. In a still more preferred embodiment, the area of the tear panel is 0.59 square inches or greater.

In another aspect of the current invention, a stay-on-tab container closure is provided comprising a generally circular center panel having upper and lower surfaces and being formed from a sheet material having a thickness. A frangible curvilinear score is formed on the upper surface of the center panel defining a displaceable tear panel, a hinge, and a fixed portion on the center panel. The tear panel has upper and lower surfaces and the upper surface of the tear panel has contour features projecting upward to a total height not greater than about 1.6 times the thickness of the sheet material. In a preferred embodiment of this aspect, the sheet material has a thickness of 0.0091 inches or less. In a more preferred embodiment of this aspect, the upper surface of the tear panel has contour features projecting upward to a total height not greater than 1.25 times the thickness of the sheet material. In a still more preferred embodiment of this aspect, the upper surface of the tear panel has contour features projecting upward to a total height not greater than 1.1 times the thickness of the sheet material. In still other embodiments of this aspect, supplemental contour features are provided on the fixed portion of the center panel. In yet another embodiment of this aspect, the area of the tear panel is 0.59 square inches or greater.

In yet another aspect of the current invention, a method for producing container closures is provided, comprising the steps of:

a) cutting a lid blank from a sheet of material;

b) forming a lid shell having a featureless center panel;

c) moving the lid shell to a conversion press having a plurality of stations;

d) forming, at one said station of said conversion press, a score on the center panel, said score defining a tear panel, a hinge, and a fixed portion, but not forming any visually perceptible contour features on said tear panel at the same said station; and e) forming, at another of said stations of said conversion press, a recessed panel encompassing said score, hinge, and tear panel, but not forming any visually perceptible contour features on said tear panel at the same said other station.

DETAILED DESCRIPTION OF THE INVENTION

Figure 1:
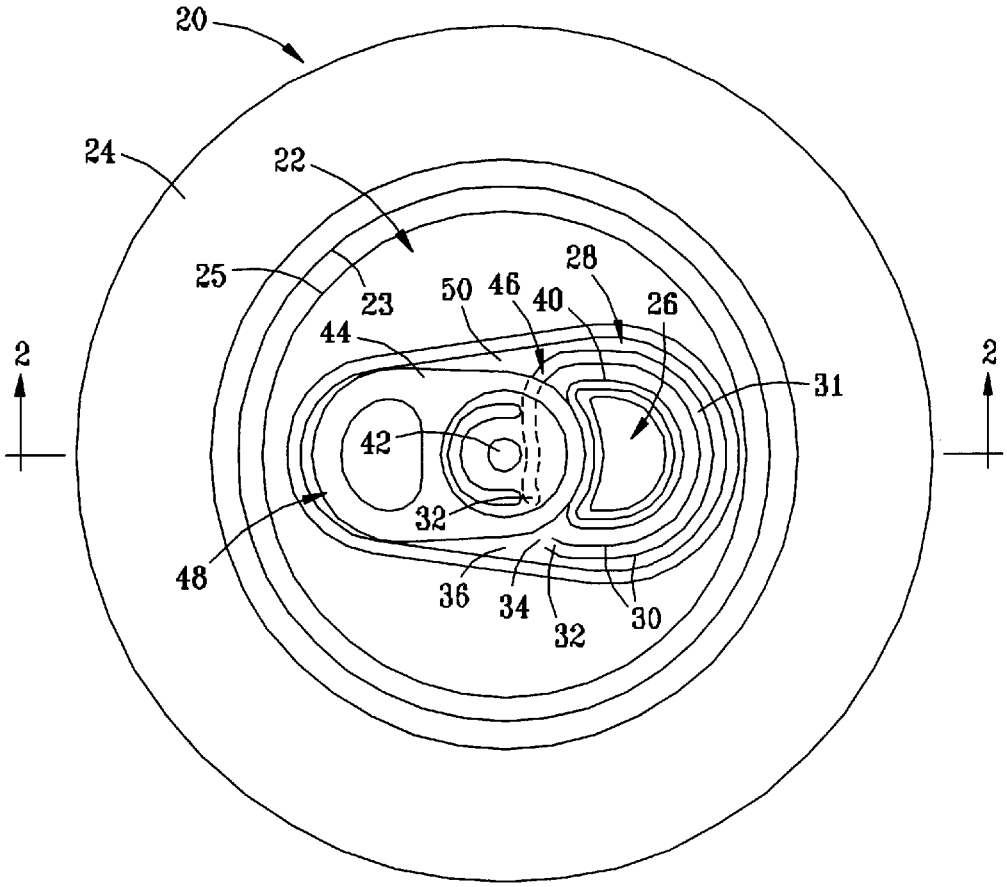
FIG. 1 (PRIOR ART)
FIG. 1 is a plan view of a PRIOR ART stay-on-tab container closure.
Figure 2:
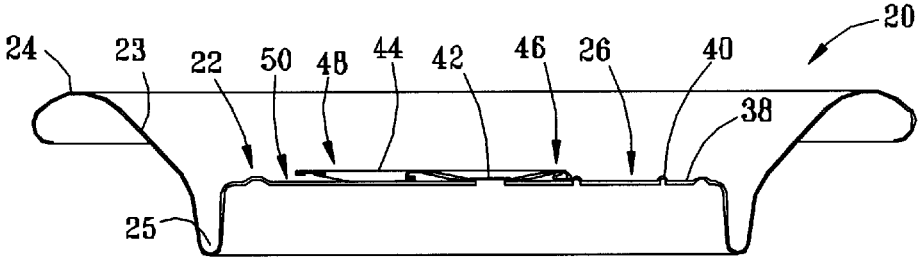
FIG. 2 (PRIOR ART)
FIG. 2 is cross-sectional view of the PRIOR ART closure of FIG. 1 taken along line 2—2 of FIG. 1.

Referring now to the drawings in detail, and in particular to FIGS. 1–4, a PRIOR ART container closure 20 is shown for comparison to the current invention. PRIOR ART container closure 20 is typical of conventional stay-on-tab container closures suitable for use on beverage cans and the like. As best seen in FIGS. 1 and 2, PRIOR ART container closure 20 comprises a generally circular center panel 22 defined by an upstanding annular chuck wall 23 which is disposed within a peripheral flange 24 and countersink 25. Center panel 22 has a tear panel 26 defined by a score 28 which forms a curvilinear pattern when viewed from above. In the closure shown, score 28 forms a generally oval pattern, however, other score line pattern shapes are known. Score 28 typically comprises two score grooves 30 disposed generally adjacent to one another and formed in the upper surface 38 of center panel 22 by pressing or stamping. Score 28 has a curving bend or "bight" portion 31 and two end portions 32 which are disposed adjacent to one another at the ends of the bight portion 31 and define therebetween a hinge portion 34 which permanently attaches tear panel 26 to a fixed portion 36 of center panel 22. The hinge portion 34 has a hinge width 35 measured between the two end portions 32. Tear panel portion 26 has a high-relief contour feature 40 which projects above upper surface 38 of tear panel 26. In the PRIOR ART closure shown, contour feature 40 takes the shape, when viewed from above, of an uppercase letter "D", and therefore may also be referred to as a "D-bead", however, contour features of many other configurations are known. PRIOR ART container closure 20 further comprises a rivet 42 disposed on the fixed portion 36 of center panel 22 proximate hinge portion 34 and an opening tab 44 secured to center panel 22 by rivet 42. Opening tab 44 has a forward portion 46 overlying tear panel 26 and a rear portion 48 overlying fixed panel portion 36. In most cases, score 28, tear panel 26, rivet 42 and opening tab 44 are disposed together in a recessed area 50 formed on center panel 22 as shown in FIG. 1. Recess 50, while preferred, is not required.

Figure 3:
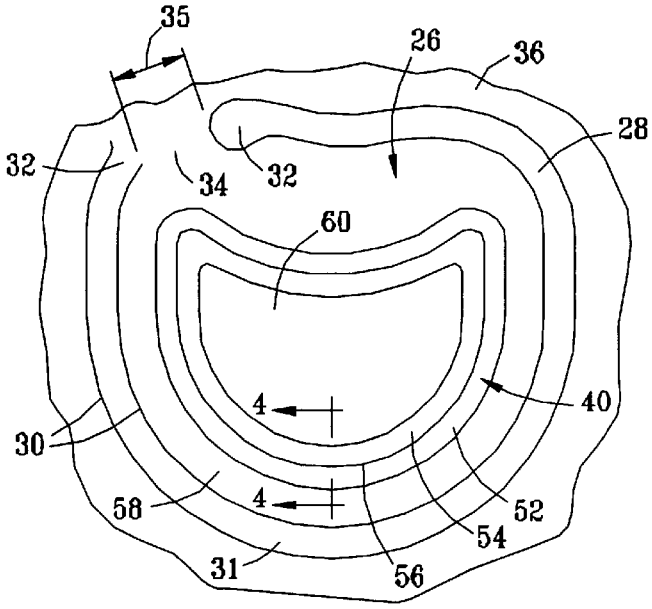
FIG. 3 (PRIOR ART)
FIG. 3 is an enlarged plan view of the score and tear panel of the PRIOR ART closure of FIG. 1.
Figure 4:
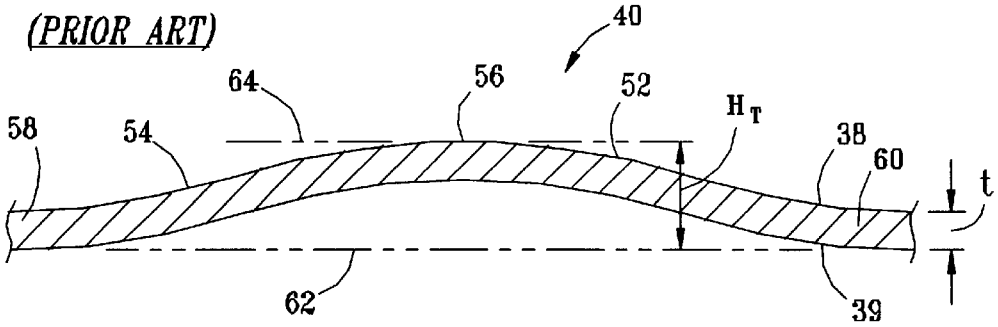
FIG. 4 (PRIOR ART)
FIG. 4 is an enlarged cross-sectional view of the high-relief contour feature of the PRIOR ART closure of FIG. 1 taken along line 4—4 in FIG. 3.

Referring now to FIGS. 3 and 4, enlarged views of the tear panel 26 of PRIOR ART closure 20 are shown. Note that in these FIGS., opening tab 40 is not shown for purposes of illustration. In the PRIOR ART tear panel 26 shown, contour feature 40 is a "D-bead" having a generally curvilinear profile, viewed in cross section, and having an outer slope 52, an inner slope 54, and an apex line 56, which is the uppermost projection of the D-bead 40 above the generally planar portions 58, 60, of tear panel 26. Other contour features are known in the art, including beads having various configurations, when viewed from above, beads having various other profiles, such as semicircular, when viewed in cross section, and other contour features such as embossments and panels.

Referring still to FIGS. 3 and 4, the D-bead contour feature 40 of PRIOR ART container closure 20 is, like all of the contour features of PRIOR ART stay-on-tab closures, a "high relief" contour feature because the total height, $H_T$, of contour feature 40 is not less than about 2 times the thickness, t, of the sheet material used for forming the closure. Referring now to FIG. 4, the total height, $H_T$, of contour feature 40 is the distance between a first line 62, which constitutes an extension of the lower surface 39 of the generally planar areas 58 and 60 adjacent to contour feature 40, and a second line 64, which is generally parallel to first line 62 and passing through the uppermost point of the upper surface 38 of contour feature 40 (i.e., the apex line 56). For example, if PRIOR ART closure 20 is formed from metal stock having a thickness, t, of approximately 0.0091 inches, then the total height, $H_T$, of heretofore known high-relief contour features is 0.0182 inches or greater.

As previously discussed, container closures having high-relief contour features on the tear panel, which were heretofore thought necessary, experience high rates of score failures when made from metal stock having a thickness of about 0.0091 inches or less, and especially when the closures incorporate large-size openings. It is believed that the formation of the high-relief contour features on the tear panel creates stresses running laterally across the score line having a magnitude that makes the score line region susceptible to fatigue cracking after the closure is incorporated into a container and subjected to the additional stresses from the pressurized contents of the completed container.

The current invention provides a stay-on-tab container closure formed from sheet material having a thickness, preferably of about 0.0091 inches or less, and having, in a first aspect, a tear panel with a smooth upper surface, that is, with no visually perceptible contour features. In an alternative aspect, the invention provides a closure having a tear panel with low-relief contour features. In both aspects of the invention, lateral stresses across the score line are reduced, thus providing improved resistance to stress-induced cracking of the score line and reduced score failure rates. The current invention has the further unexpected benefit of exhibiting conventional opening characteristics, e.g., the current invention does not experience operating problems such as nose failures, tuck-under failures, and partial opening type failures at rates significantly different than for comparable closures having the previously believed necessary high-relief contour features. The unexpected benefit of the current invention further extends to use on closures having large-size openings.

Figure 5A:
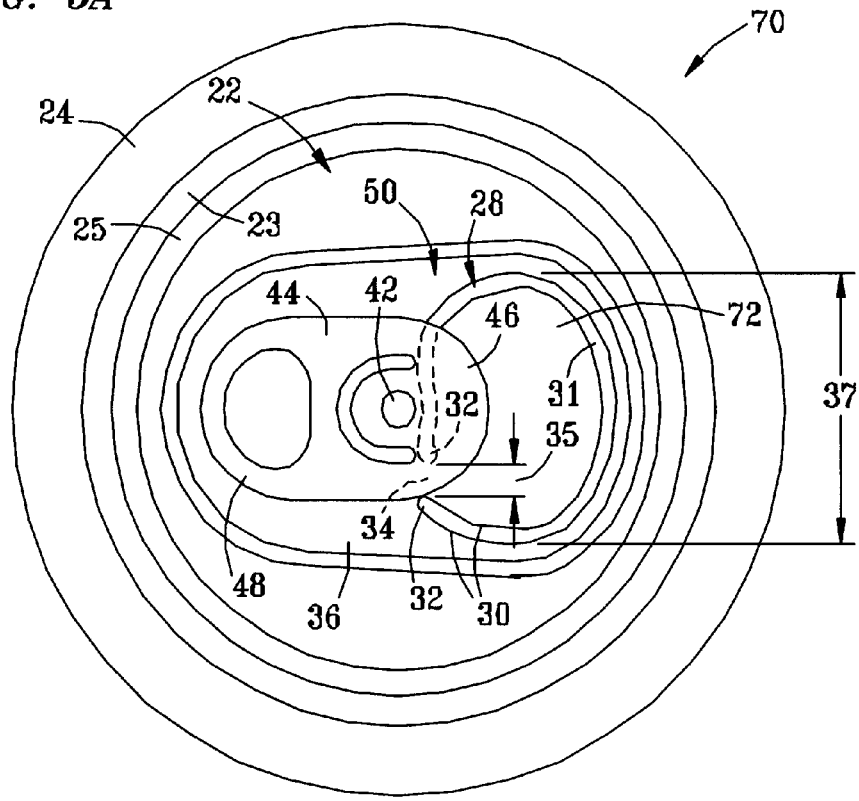
FIG. 5A is a plan view of a container closure according to one aspect of the current invention.
Figure 5B:
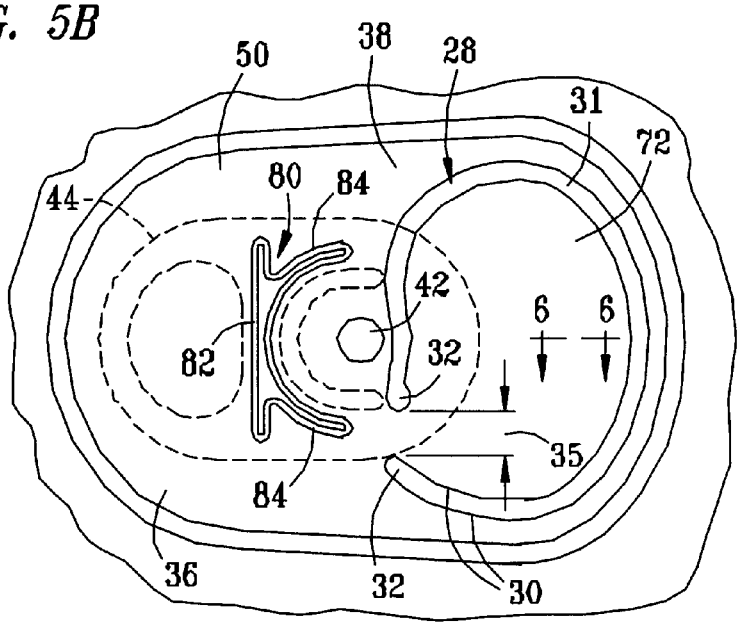
FIG. 5B is a partial plan view of the closure of FIG. 5A with the opening tab shown in phantom to show the underlying panel.
Figure 6:
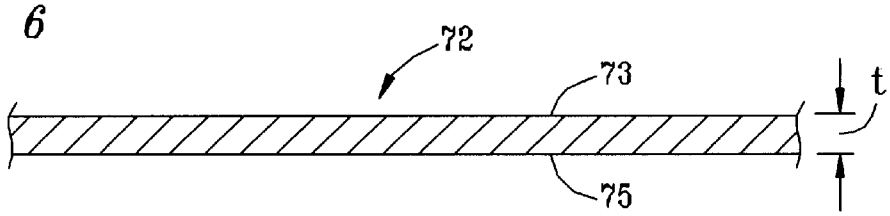
FIG. 6 is an enlarged cross-sectional view of the tear panel of the closure of FIG. 5A taken along line 6—6 in FIG. SB.

Referring generally now to FIGS. 5A, 5B, and 6, a container closure 70 according to a first aspect of the invention is shown. Closure 70 is formed from sheet material having a thickness, preferably of approximately 0.0091 inches or less. Referring first to FIG. 5A, closure 70 comprises a generally circular center panel 22, and can include an annular chuck wall 23, a peripheral flange 24, a countersink 25, and a recessed panel 50 similar to the PRIOR ART closure previously discussed and illustrated in FIGS. 1 and 2. Alternatively, center panel 22 can be connected to other peripheral annular structures (not shown) as is known in the art to adapt the closure to the specific geometry of the associated container. Center panel 22 of closure 70 has a curvilinear score 28 defining a tear panel 72, a hinge 34, and a fixed portion 36. In the embodiment shown, score 28 comprises two separate score grooves 30 disposed generally adjacent to one another and formed in the upper surface 38 of center panel 22 by pressing or stamping. While this configuration of score 28 is preferred, a score having a single groove or larger number of grooves is within the scope of the current invention. Score 28 has a curving bight portion 31 and two end portions 32 which are disposed adjacent to one another at the ends of the bight portion 31 and define therebetween the hinge portion 34 which permanently attaches tear panel 72 to the fixed portion 36 of center panel 22. The hinge portion 34 has a hinge width 35 measured between the score end portions 32. Hinge width 35 is less than 25% of the maximum width (shown as 37) of the tear panel 72. In the embodiment shown in FIG. 5A, closure 70 is of the "large-size" type, because the tear panel 72 has an area greater than 0.59 square inches. It will be readily apparent, however, that the current invention is also applicable to container closures of the "standard-size" opening type. As best seen in FIG. 6, the tear panel 72 of closure 70 has upper and lower surfaces 73, 75, respectively. Still referring to FIG. 6, the upper surface 73 of tear panel 72 is smooth, that is, it has no visibly perceptible contour features projecting upward from the upper surface 73. For the purposes of this application, "visually perceptible" contour features are features projecting upwards which can by perceived by an ordinary person using the unaided eye. Lettering or other indicia incised into the upper surface 73 of tear panel 72 could be visually perceptible, but would not constitute a contour feature because they do not project upwards. It should be noted that since the upper surface 73 of tear panel 72 is smooth, the cross section shown in FIG. 6 would apply to all regions of tear panel 72.

Referring again to FIGS. 5A and 5B, container closure 70 further comprises a rivet 42 disposed on the fixed portion 36 of center panel 22 proximate hinge portion 34 and an opening tab 44 secured to center panel 22 by rivet 42. Opening tab 44 has a forward portion 46 overlying tear panel 72 and a rear portion 48 overlying fixed panel portion 36. In some cases, score 28, tear panel 72, rivet 42 and opening tab 44 may be disposed together in a recessed area 50 formed on center panel 22 as shown in FIGS. 5A and 5B, however, recess 50 is not required. The operation of closure 70 is similar to the operation of previous stay-on-tab closures: Lifting the rear portion 48 of opening tab 44 causes the tab to exert forces on tear panel 72 and fixed portion 36 of the center panel 22 to rupture score 28 and displace tear panel 72 downward into the associated container (not shown) to form an opening for dispensing the contents of the container. These opening procedures apply to closures with standard-size openings and to containers with large-size openings.

Referring now to FIG. 5B, which shows opening tab 44 in phantom to reveal underlying structures on the center panel 22, in a more preferred embodiment of the current invention, supplemental contour feature 80 is provided on fixed portion 36 of center panel 22 proximate rivet 42. Supplemental contour feature 80, while preferred, is not required. Supplemental contour feature 80 further stiffens and reinforces the center panel 22 to improve opening performance of the closure 70 without introducing lateral stresses across the score 28 which can lead to increased score failure rates. Supplemental contour feature 80 can therefore be of either "high-relief" or "low-relief" type, when viewed in cross section. In the embodiment shown in FIG. 5B, the supplemental contour feature 80 has a configuration, when viewed from above, of a "picnic table" having a generally straight "top" feature 82, which is spaced apart from rivet 42, and two curvilinear "leg" features 84, which are attached to top feature 82 and curve around rivet 42 at a generally constant radius. It will be appreciated that many other configurations for the supplemental contour feature 80 are within the scope of the current invention.

Figure 7:
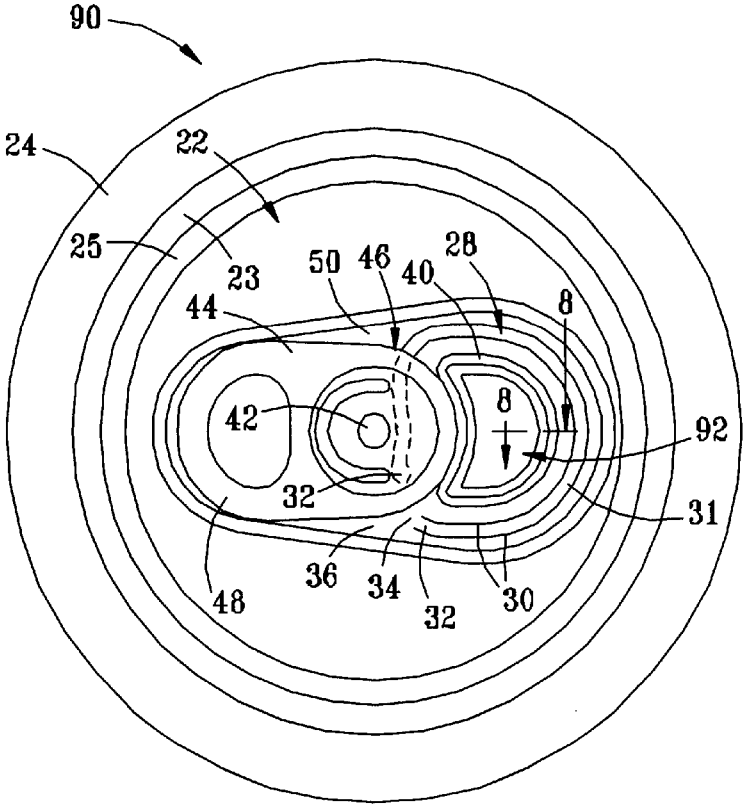
FIG. 7 is a plan view of a container closure according to a second aspect of the current invention.
Figure 8:
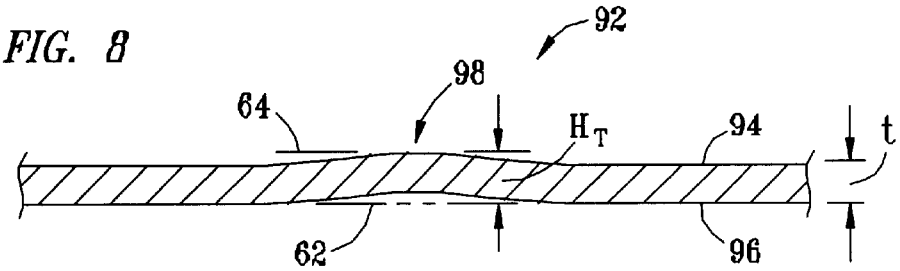
FIG. 8 is an enlarged cross-sectional view of the low-relief contour feature of the closure of FIG. 7 taken along line 8—8 in FIG. 7.

Referring now to FIGS. 7 and 8, a container closure 90 according to a second aspect of the current invention is shown. Closure 90 comprises many of the same structures found in the closures previously discussed, as shown by their like-numbering in FIG. 7. The tear panel 92 of closure 90, however, has upper and lower surfaces 94, 96, respectively, and low-relief contour features 98 formed on upper surface 94. As best seen in FIG. 8, when viewed in cross section, the low-relief contour features 98 of tear panel 92 have a total height, $H_T$, that is not greater than about 1.6 times the thickness, t, of the sheet material used for forming the closure. For example, for a closure in which the thickness, t, of the stock metal is approximately 0.0091 inches, the total height, $H_T$, of low-relief contour features 98 on tear panel 92 will be less than about 0.0146 inches.

Figure 9A:
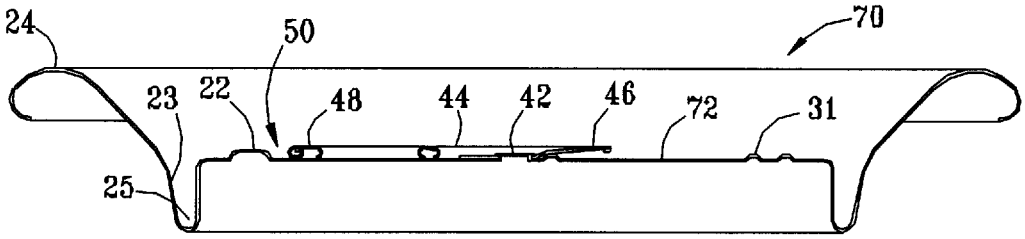
FIG. 9*a* is a cross-sectional view of the container closure of FIG. 5*a;*
Figure 9B:
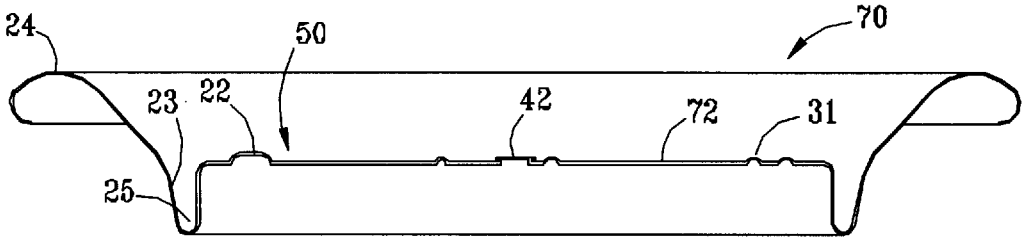
FIG. 9*b* is a cross sectional view of the container closure of FIG. 5*b;*
Figure 10:
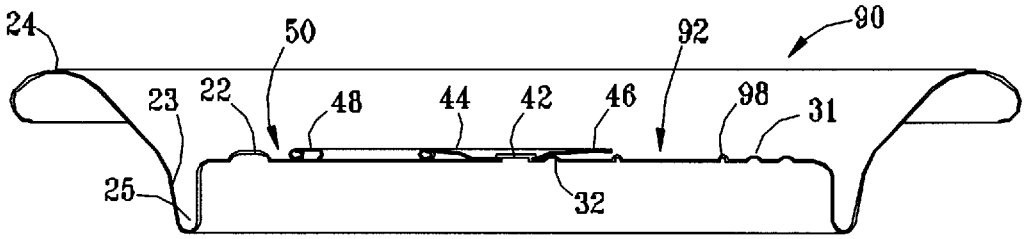
FIG. 10 is a cross sectional view of the container closure of FIG. 7.

Referring now to FIGS. 9*a*, 9*b*, and 10, which show cross sectional views of FIGS. 5*a*, 5*b*, and 7, respectively. These views show that recessed area 50 of the container closure according to the present invention is recessed below, or at a lower elevation relative to, center panel 22.

Container closures according to the current invention exhibit normal operating performance during opening, both for closures with standard-size openings and for closures with large-size openings. The low-relief contour features 98 of upper surface 94 of the tear panel 92 of the current invention does not cause an increase in operational problems such as nose failure, tuck-under type failure, or partial opening type failure as was heretofore predicted in the art. Further, because formation of the low-relief contour features 98 of the tear panel 92 gathers in the metal of the tear panel to a lesser extent than formation of the high-relief contour features on the tear panel of previously known closures, the closures of the current invention have less stress running laterally across the score area. This relative stress reduction across the score area provides closures according to the current invention with a significant improvement in resistance to fatigue cracking relative to previously known closures. In addition, the low-relief contour features 98 do provide a visually perceptible contour feature on the tear panel 92, which may be desirable for providing alignment or for aesthetic purposes.

In a more preferred embodiment of this aspect, low-relief contour features 98 have a total height, $H_T$, that is not greater than about 1.25 times the thickness, t, of the sheet material used for forming the closure. In a still more preferred embodiment of this aspect, low-relief contour features 98 have a total height, $H_T$, that is not greater than about 1.10 times the thickness, t, of the sheet material used for forming the closure. In each of the preferred embodiments, even less metal of the tear panel 92 is gathered in by the low-relief contour features 98, to further reduce the tension in the metal, however, a visually perceptible contour feature is provided suitable for the purposes described above.

Closures according to the current invention having no contour features on the tear panel, such as closure 70 shown in FIG. 5, have further advantages over the known art. Since no contour features need be formed on the tear panel 72, the tooling required to produce the closures is simplified. In addition, the smooth flat upper surface of the tear panel 72 provides additional area on the closure 70 suitable for incising indicia as may be required by governmental regulations or business purposes.

Yet another aspect of the current invention provides a method for producing container closures having improved fatigue crack resistance, the method comprising the steps of:

a) cutting a closure blank from a sheet material having a thickness;

b) forming a closure shell having a featureless center panel;

c) moving the closure shell to a conversion press having a plurality of stations;

d) forming on said closure shell, at one of said stations of said conversion press, a score on the center panel, said score defining a tear panel, a hinge, and a fixed portion, but not forming any visually perceptible contour features on said tear panel at the same said station; and e) forming on said closure shell, at another of said stations of said conversion press, a recessed panel encompassing said score, hinge, and tear panel, but not forming any visually perceptible contour features on said tear panel at the same said other station.

The details of each step of this aspect of the current invention are well known to those in the art. In addition, it will be readily appreciated, for example, that additional operations known in the art may be performed at conversion press stations preceding and subsequent to the two stages described in steps d) and e) above. It is the unique combination of steps described above which provides the unexpected benefit of increased fatigue crack resistance, especially for closures formed from sheet material having a thickness of about 0.0091 inches or less, and more especially for such closures having large size openings.

While the preferred embodiment of the invention has been disclosed with reference to particular aspects of container closures and the functioning thereof, it is to be understood that many changes in detail may be made as a matter of engineering choices without departing from the spirit and scope of the invention, as defined by the appended claims.

I claim:

1. A stay-on-tab container closure comprising:

(a) a circular center panel formed from a sheet material having a thickness;

said center panel having upper and lower surfaces;

(b) a recessed area formed on said center panel at a lower elevation than the remaining portions of said center panel;

(c) a frangible score formed on said upper surface of said center panel and disposed within said recessed area;

said score, when viewed from above, having a curvilinear bight portion and two end portions disposed at the ends of said bight portion in spaced-apart relation to one another;

said bight portion defining most of the periphery of a downwardly displaceable tear panel;

said end portions defining therebetween a hinge portion which permanently attaches said tear panel to a fixed portion of said center panel;

(d) said tear panel being flat and without axial curvature and having upper and lower surfaces;

said surfaces of said tear panel being smooth and without visually perceptible contour features;

(e) a rivet disposed on said fixed portion of said center panel within said recessed area proximate said hinge portion; and (f) an opening tab hingedly secured to said rivet, said opening tab having a forward portion overlying said tear panel, said forward portion having a forward edge smoothly curving about said rivet.

2. A stay-on-tab container closure according to claim 1, wherein said thickness of said sheet material is not more than about 0.0091 inches.

3. A stay-on-tab container closure according to claim 1, wherein said tear panel has an area of at least about 0.59 square inches.

4. A stay-on-tab container closure according to claim 3, wherein said sheet material is formed from a substance selected from the group consisting of aluminum and aluminum alloys.

5. A stay-on-tab container closure according to claim 2, further comprising supplemental contour features formed on said fixed portion of said center panel proximate said rivet.

6. A stay-on-tab container closure according to claim 5, wherein said supplemental contour features comprise a raised bead having a first straight portion spaced apart from said rivet and two curvilinear portions joined to said straight portion and disposed along a curved path about said rivet at a fixed distance from said rivet.

7. A stay-on-tab container closure according to claim 1, wherein said sheet material is formed from a substance selected from the group consisting of aluminum and aluminum alloys.

* * * * *

UNITED STATES PATENT AND TRADEMARK OFFICE

CERTIFICATE OF CORRECTION

PATENT NO. : 6,234,336 B1
DATED : May 22, 2001
INVENTOR(S) : Neiner

It is certified that error appears in the above-identified patent and that said Letters Patent is hereby corrected as shown below:

Column 5,
Line 37, delete "SB" insert --5B --

Signed and Sealed this

Nineteenth Day of February, 2002

*Attest:*

*Attesting Officer*

JAMES E. ROGAN
*Director of the United States Patent and Trademark Office*